United States Patent [19]

Cadisch

[11] Patent Number: 4,993,194

[45] Date of Patent: Feb. 19, 1991

[54] GRINDING DISKS FOR PROFILING CYLINDRICAL WORMS

[75] Inventor: Jakob Cadisch, Gossau, Switzerland

[73] Assignee: Reishauer AG, Wallisellen, Switzerland

[21] Appl. No.: 299,381

[22] Filed: Jan. 23, 1989

[30] Foreign Application Priority Data

Feb. 12, 1988 [CH] Switzerland ..... 529/88

[51] Int. Cl.[5] ..... B23F 21/03; B24B 33/00; B24D 5/00; B24D 7/00

[52] U.S. Cl. ..... 51/206 R; 51/209 R; 51/105 GG

[58] Field of Search ..... 51/206.4, 206 R, 287, 51/288, 206 P, 106 R, 105 GG, 209 R, 95 GH

[56] References Cited

U.S. PATENT DOCUMENTS

| | | | |
|---|---|---|---|
| 2,426,290 | 8/1947 | Wainwright | 51/206 P |
| 2,668,401 | 2/1954 | Reimschissel | 51/206 P |
| 3,023,546 | 3/1962 | Beck | 51/288 |
| 3,491,493 | 1/1970 | Deist | 51/106 R |
| 3,772,831 | 11/1973 | Shaw | 51/206 R |
| 4,114,322 | 9/1978 | Greenspan | 51/206 R |
| 4,354,328 | 10/1982 | Ainoura | 51/206.4 |
| 4,393,625 | 7/1983 | Bloch et al. | 51/123 G |
| 4,475,319 | 10/1984 | Wirz | 51/287 |
| 4,815,239 | 3/1989 | Sommer | 51/52 R |

*Primary Examiner*—Frederick R. Schmidt
*Assistant Examiner*—John R. Schwarzmann
*Attorney, Agent, or Firm*—Sughrue, Mion, Zinn, Macpeak & Seas

[57] ABSTRACT

A contouring tool for grinding cylindrical worm profiles includes two disks 46, 47 having hard grain coated surfaces 48, 49 for contouring the opposing flanks 3, 4 of the grinding worm 1. Hard grain coated parts 50, 52, which are provided for contouring the root and crest sections 5, 6 that directly adjoin the flanks 3 to be dressed with one disk 47, are mounted on the other disk 46. The surfaces 48, 49 can thus be lapped. A grinding worm 1 can be contoured in one operation with this tool.

10 Claims, 1 Drawing Sheet

GRINDING DISKS FOR PROFILING CYLINDRICAL WORMS

BACKGROUND OF THE INVENTION

This invention relates to a contouring tool for grinding cylindrical worm profiles, in turn used to grind gear wheels.

Several processes are known for profiling cylindrical grinding worms, which are used to grind the teeth on usually predressed and hardened gear wheels.

A quite accurate, but slow and time-consuming process constitutes generating the contour of the worm by means of shaped diamonds that are ground. The diamonds are used in the same manner as turning tools, and the procedure for this type of contouring can be compared with the cutting of a thread with a lathe. Since this process is slow and since the shaped diamond tools are very sensitive and uneconomical, this process is rarely used today.

Another possibility is called the crushing process in which a crusher roll without its own drive is forced against the slowly turning grinding worm with great force. In this manner the dulled grains are dislodged from the disk matrix and the contour of the worm gradually assumes the shape of the contour of the crusher roll. This process has the advantage that such contoured shapes as crown and root reliefs can be produced without any great difficulties. However, one drawback is the relatively rapid wear of the crusher roll during contouring, and the very large forces that occur during the crushing procedure.

Similarly, the contouring roll has also been known for a long time. Such a roll has a layer of grains made of a hard substance, and its outer diameter is shaped to match the contour of the grinding worm. In contrast with the crusher roll, it is driven at a high speed with a motor, and the contour of the worm is produced by means of a cutting process with relatively little energy. The drawback of this process is that the very high accuracy, which must be demanded of the contouring roll, can hardly be attained. It is impossible to coat the foundation of the roll with grains of a hard substance having the requisite quality.

Simple, conical profiling disks are also known that are coated with hard material grains. However, with these contouring disks only the flank portions of the grinding worms can be contoured. These contouring disks can be lapped and thus achieve high precision. Such contouring disks are usually used in pairs, one for the left and one for the right flank profile of a disk. The drawback of the contouring disks that are most commonly used today is that the crest and/or root radii of the grinding worm profile cannot be contoured at the same time in the course of the operation, thus making the automation of the contouring process more complicated.

SUMMARY OF THE INVENTION

These drawbacks and disadvantages of the prior art are effectively overcome in accordance with the invention by providing a pair of grinding disks, one having converging side surfaces coated with hard material grains for contouring the opposite flanks of the worm groove, and the other having a radially outermost surface flanked by radially inner surfaces, similarly coated, for contouring the root and crown portions of the groove, respectively. In another embodiment the disks have complementary surfaces arranged such that each disk contours or grinds one of the groove flanks, and overlapping halves of both the root and crown portions.

DETAILED DESCRIPTION OF THE PREFERRED EMBODIMENTS

Figure 1:
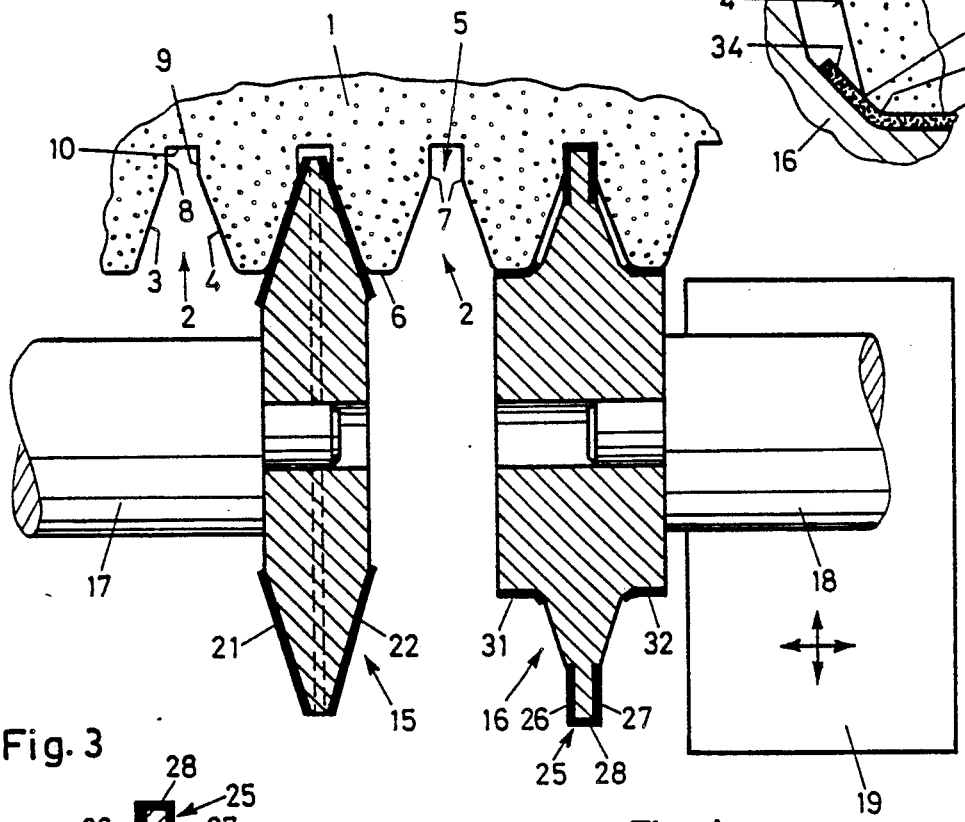
FIG. 1 is an axial sectional view of a first embodiment of a profiling tool in accordance with the invention.
Figure 2:
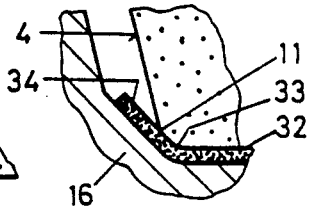
Fig. 2 is an enlarged view of a portion of FIG. 1.

The tool according to FIG. 1 serves to contour a cylindrical worm 1 in order to grind spur gears in a continuous gear cutting process. The grinding worm 1 has a spiral groove 2 with a first flank 3 to grind one tooth flank, a second flank 4 to grind the other, opposite tooth flank, a root section 5, and a crest section 6. The root section 5 comprises both radial subsections 8, 9 which adjoin the flanks 3, 4 by means of convex edges 7, and an approximately cylindrical subsection 10. The approximately cylindrical crest section 6 transforms on both sides from a rounding and a convex edge 11 into the flanks 3, 4 (FIG. 2). When the related gear wheel is ground, the root section 5 does not engage with the gear wheel.

In the embodiment of FIG. 1, the profiling tool comprises two rotationally symmetrical disks 15, 16, each of which are clamped on a separate, motor-driven spindle 17, 18. The spindle 18 is mounted on a compound slide 19 and thus can be adjusted axially and radially with respect to the spindle 17. The bearing of the spindle 17 (not illustrated) and the compound slide 19 are mounted on a profiling slide (not illustrated) that moves back and forth, in dependance on the rotary motion of the grinding worm 1, and parallel to the worm axis in order to generate the spiral groove 2.

The disk 15 serves to contour the flanks 3, 4, and has for this purpose shaped surfaces 21, 22. These surfaces are longer axially than the flanks 3, 4 and project above and below the edges 7, 11, respectively, when engaging the grinding worm 1. The surfaces 21, 22 are coated with hard material grains, e.g. with grains made of diamond or cubic boron nitride. Since the surfaces exhibit no sharp edges in an axial section, they can be lapped, since the lapping wheels can run out laterally so that the flanks 3, 4 of the grinding worm 1 can be contoured with very high accuracy.

The second disk 16 has an outer part 25 that is coated with hard material grains in order to contour the root section 5. The part 25 comprises two flat sides 26, 27 and a cylindrical tip 28. The cylindrical tip 28 alone would suffice but it is advantageous, for the purpose of better edge stability, to also coat the sides 26, 27. On flanking sides of the part 25 the disk 16 has approximately cylindrical parts 31, 32 that are coated with a hard material grain in order to each contour approximately half of the crown section 6. Each part 31, 32 changes over from a rounding 33 into a conical subpiece 34, which has a somewhat smaller angle of opening than the flanks 3, 4 adjacent the edge 11 (FIG. 2). Since there is no demand for high accuracy at the root and crown sections 5, 6 of the grinding worm 1, the parts 25, 31, 32 do not have to be lapped.

During operation the second disk 16 is aligned with respect to the first disk 15 with the compound slide 19 such that in the course of the same operation not only the flanks 3, 4 but also the root and crest sections 5, 6 are contoured simultaneously. Thus, the contouring of the grinding worm 1 can be automated in a simple manner.

As indicated by the dashed lines in FIG. 1, the disk 15 can be composed of two subdisks and a spacer. By replacing the spacer, the disk can be adapted to other widths of the groove 2.

Figure 3:
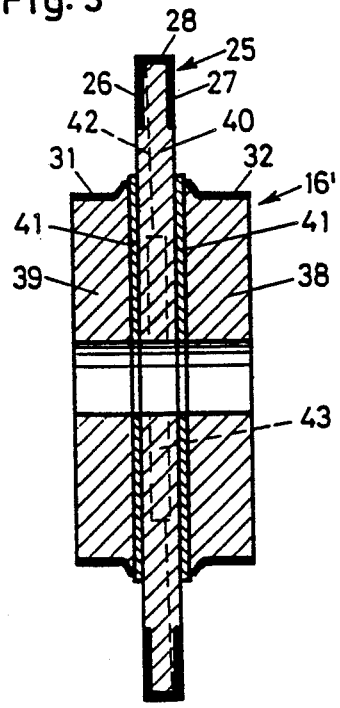
FIG. 3 shows a variation of the embodiment of FIG. 1.

An analogous solution is shown in FIG. 3 for the second disk 16', which in this case comprises three partial disks 38, 39, 40 and two spacing disks 41. As indicated by the dashed lines, the center disk 40 can also be subdivided by a junction 42 that is slightly tilted in the radial direction. Thus, even the width of the partial disk 40 can be adjusted by means of spacers 43. Due to the tilted junction 42 the circumferential sections forming the cylindrical tip 28 overlap when the disk 16' rotates.

Figure 4:
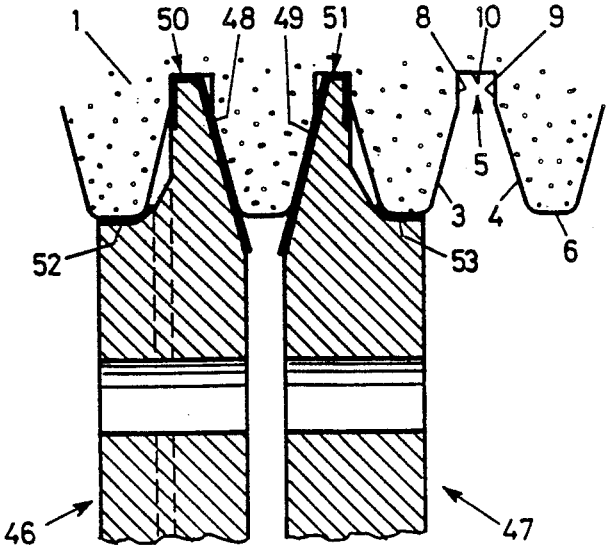
FIG. 4 is an axial sectional view of a second embodiment of the invention.

FIG. 4 shows a second embodiment of the invention. In this case the two disks 46, 47 are constructed the same way and each has a hard grain coated surface 48 or 49 to contour the two flanks 3, 4. A hard grain coated part 50 for contouring the left half of the root section 5, i.e. the subsection 8 and the adjoining half of the subpiece 10, adjoins the outer circumference of the surface 48 for contouring the right flank 4. The second disk 47 has a corresponding part 51 for contouring the other half of the root section 5. At the sides opposite the surfaces 48, 49 each disk 46, 47 has a part 52 or 53 for dressing the two halves of the crest section 6. The two disks 46, 47 can be securely clamped on a common, driven spindle or, if an individual small adjustment possibility of the two disks with respect to one another is desired, each disk can be securely clamped to a separate, individually driven spindle. The dashed lines in disk 46 indicate that even this disk as well can be built from several partial disks and spacing disks.

What is claimed is:

1. A rotating contouring tool for profiling in a single operation a cylindrical grinding worm (1) which is designed for grinding gear wheels in a continuous gear cutting process and which has a first grinding worm flank (3) for dressing a tooth flank, a second grinding worm flank (4) opposite the first flank for dressing an opposing tooth flank, a root section (5) and a crown section (6), said tool comprising: two simultaneously rotatable disks (15, 16; 46, 47), one (15; 47) of said disks having at least one first surface (21, 49) for contouring only the first grinding worm flank (3), and the other disk (16; 46) having additional surfaces (25, 31; 50, 52) for simultaneously contouring only the grinding worm root and crown sections, said grinding worm root and crown sections directly adjoining the first grinding worm flank.

2. A tool as claimed in claim 1, wherein said one disk (15) has two first surfaces (21, 22) for individually contouring only the first and second grinding worm flanks (3, 4), respectively.

3. A tool as claimed in claim 2, wherein said other disk (16) comprises several disk parts (38, 39, 40) separated by interposed spacer disks (41), one of said disk parts (40) having said surface (26, 27, 28) for contouring the root section and at least a further one of said disk parts (38, 39) having said surface (31, 32) for contouring the crown section.

4. A tool as claimed in claims 2 or 3, wherein said other disk (16) has two separate surfaces (31, 32) for contouring the crown sections (6), each of said separate surfaces having a rounded portion (33) for dressing parts of the crown sections (6) that adjoin a grinding worm flank.

5. A tool as claimed in claim 1, wherein two surfaces (48, 49) for contouring the two grinding worm flanks (3, 4) are individually mounted on the two disks (46, 47), respectively.

6. A tool as claimed in claim 5, wherein each disk (46, 47) has an external surface (50, 51) for contouring a portion of the root section (5) which adjoins a grinding worm flank (4, 3) contoured by the other disk, and wherein surfaces (52, 53) for contouring the crown section (6) which adjoins the other grinding worm flank (4, 3) are mounted on the side of the disk opposite the first surface (48, 49).

7. A tool as claimed in claims 3 or 6, wherein the surfaces (21, 22; 48, 49) for contouring the grinding worm flanks (3, 4) are lapped.

8. A tool as claimed in claims 3 or 6, wherein the surfaces (21, 22; 48, 49) for contouring the grinding worm flanks (3, 4) and the surfaces (25, 31, 32; 50–53) for contouring the root and crown sections (5, 6) are coated with hard material grains made of diamond or cubic boron nitride.

9. A tool for profiling in one operation a cylindrical grinding worm (1), in turn used to grind gear wheels, said tool comprising:

(a) a first rotatable disk (15) having radially converging side surfaces (21, 22) coated with hard abrasive particles for contouring opposite flanks (3, 4) of a helical groove (2) in said worm, and (b) a second simultaneously rotatable disk (16) disposed axially parallel to and spaced from the first disk, said second disk having:

(1) a rectangularly sectioned radially outermost tip portion (25) coated with hard abrasive particles for contouring a root portion (5) of the groove, and (2) a pair of radially inner, generally cylindrical surfaces (31, 32) flanking said outermost surface, having outturned facing edges (34), and coated with hard abrasive particles for cooperatively contouring a crest portion (6) of the groove.

10. A tool for profiling in one operation a cylindrical grinding worm (1), in turn used to grind gear wheels, said tool comprising:

(a) a first rotatable disk (46) having:

(1) a radially inclined first side surface (48) coated with hard abrasive particles for contouring a first flank (4) of a helical groove (2) in said worm, (2) a radially outermost L-sectioned tip portion (50) adjoining said first side surface and coated with hard abrasive particles for contouring approximately one-half of a root portion (5) of the groove, and (3) a radially inner, generally cylindrical surface (52) disposed opposite said first side surface, having an outturned inner edge, and coated with hard abrasive particles for contouring approximately one-half of a crest portion (6) of the groove, and (b) a second simultaneously rotatable disk (47) disposed axially parallel to and spaced from the first disk, said second disk having:

(4) a radially inclined second side surface (49) coated with hard abrasive particles for contouring a second flank (3) of the groove, (5) a radially outermost L-sectioned tip portion (51) adjoining said second side surface and coated with hard abrasive particles for contouring approximately another one-half of the root portion of the groove, and (6) a radially inner, generally cylindrical surface (53) disposed opposite said second side surface, having an outturned inner edge, and coated with hard abrasive particles for contouring approximately another one-half of the crest portion of the groove.

* * * * *